United States Patent [19]

Stohlquist et al.

[11] 4,306,401

[45] Dec. 22, 1981

[54] PACKAGING APPARATUS

[75] Inventors: Roger H. Stohlquist; Leo Strombeck, both of Rockford, Ill.

[73] Assignee: Anderson Bros. Mfg. Co., Rockford, Ill.

[21] Appl. No.: 92,704

[22] Filed: Nov. 9, 1979

[51] Int. Cl.[3] ..... B65B 1/02; B65G 37/00; B65G 25/04

[52] U.S. Cl. ..... 53/564; 198/621; 198/740; 198/741

[58] Field of Search ..... 53/565, 266 R, 564, 53/566; 93/53 R; 141/131; 198/621, 726, 727, 740, 741, 742, 748

[56] References Cited

U.S. PATENT DOCUMENTS

| | | | |
|---|---|---|---|
| 2,612,016 | 9/1952 | Anderson | 53/564 X |
| 3,061,078 | 10/1962 | Davies | 198/621 |
| 3,172,435 | 3/1965 | Anderson | 141/131 |
| 3,298,288 | 1/1967 | Anderson | 93/53 R |
| 3,364,651 | 1/1968 | Stohlquist | 53/266 R |
| 3,613,331 | 10/1971 | Garrett | 198/740 X |
| 3,701,410 | 10/1972 | Shields | 198/621 X |
| 3,939,992 | 2/1976 | Mikulec | 198/621 X |

*Primary Examiner*—Horace M. Culver
*Attorney, Agent, or Firm*—Vernon J. Pillote

[57] ABSTRACT

A packaging apparatus for erecting, filling and closing generally rectangular cartons which are supplied in an initially flattened condition. The packaging apparatus has a filling station, lateral carton guides for guiding cartons from a carton infeed station past the filling station to a delivery station. An elongated carrier member extends along the path and has rigid pusher fingers at spaced locations therealong extending crosswise of the path, and the carrier members are driven by spaced carrier drives each including four sprockets and a chain entrained around the sprockets and connected to the carrier members to move them in a generally rectangular closed loop course.

16 Claims, 13 Drawing Figures

32
34
52
53
122
54
123
116
28
115
40
26
121
31
102
40
101
13
94
13
41'
99
52
95
59
93
41
98
107
27
61
53
71
110
109
30
58
108
25
57
56
76
72

PACKAGING APPARATUS

Packaging apparatus have heretofore been made, for example, as shown in U.S. Pat. Nos. 2,612,016; 3,172,435; 3,298,288 and 3,364,651, in which flattened carton blanks are set up or erected at a carton set-up station, and then advanced in step fashion past several stations including a bottom carton closing station, a filling station, and a top carton closing station. In the packaging apparatus disclosed in the foregoing mentioned patents, the cartons were guided between laterally spaced carton guides for movement along a path past the several stations, and a reciprocating type transfer mechanism was provided that included slides at opposite sides of the path and fingers resiliently mounted on the slides at spaced locations therealong to project into the path and engage the cartons during forward movement of the slides and to be cammed out of the path during retraction of the slides. Such resilient fingers, however, only engaged the cartons adjacent their trailing corners and the side panels of the cartons that extended transversely between the guide rails were not supported across therewith during advancement of the cartons. In packaging apparatus using such prior reciprocating type transfers mechanisms, cartons that where weakened by tear strips formed in the carton and cartons that were formed of relatively light weight stock, sometimes tended to buckle or deform and cause a jam in the packaging apparatus.

It is the object of the present invention to overcome the problems of carton distortion and buckling sometimes encountered in the prior packaging apparatus by providing a packaging apparatus having an improved transfer mechanism which supports the cartons across their entire width during advance of the cartons through the packaging apparatus.

Accordingly, the present invention provides a packaging apparatus having a filling station and laterally spaced carton guides for guiding cartons for movement along a path past the filling station, a conveyor means including at least one elongated carrier member paralleling the path having a plurality of transverse pusher fingers rigid with the carrier member at spaced locations therealong and extending in a direction crosswise of the path, first and second carrier drives spaced apart in a direction lengthwise of the carrier member and offset from one side of the path with each carrier drive including a set of four sprockets arranged in a generally rectangular pattern and an endless chain entrained around the sprockets of each set, first and second connector means rotatably connecting the carrier member to the endless chain of the first and second carrier drives, means for driving the chains of the first and second carrier drives in one direction and at the same speed, the sprockets of each set being arranged such that the chains of the first and second carrier drives, when driven in the one direction, move the carrier member in a horizontal closed loop course of generally rectangular configuration with rounded corners, the course having inward and outward runs extending respectively toward and away from the path and forward and return runs extending generally lengthwise of the path, and the fingers of the carrier member having a length sufficient to span the space between the lateral carton guides on the forward run and being retracted out of the path on the return run.

These, together with other features and advantages of the present invention will be more readily understood by reference to the following detailed description, when taken in connection with the accompanying drawings wherein.

Figure 12:
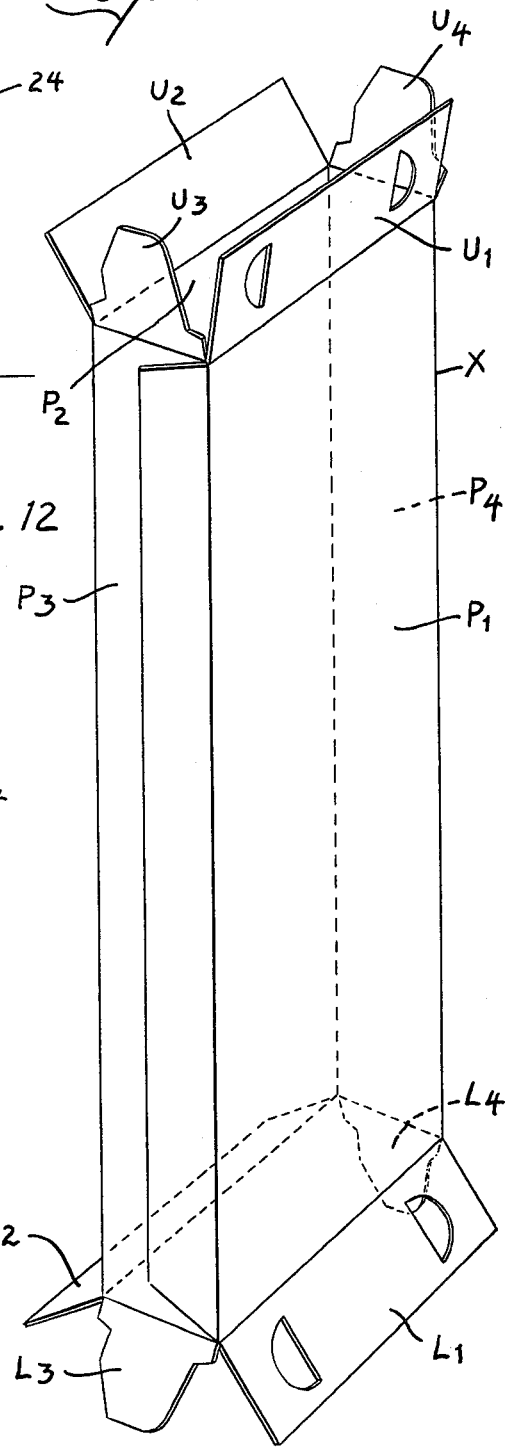
FIG. 12 is a perspective view of a carton of the type adapted to be erected, filled and closed by the packaging machine.

The packaging apparatus is generally adapted for use in filling cartons but is particularly advantageous for use in erecting, filling and closing generally rectangular cartons of a type that are initially supplied in a flattened condition. The cartons may, for example, be of the type designated generally by the letter X in FIG. 12 having first and second rectangular side panels P1 and P2 interconnected along score lines to rectangular end panels P3 and P4. The cartons are initially in a flattened condition with one end panel P3 and one side panel P1 at one side of the flattened carton and the other side panel P2 and end Panel P3 at the other side of the flattened carton. Means such as upper end closure flaps U1-U4 are commonly provided on the upper ends of panels P1-P4 for closing the upper end of the cartons and means such as lower closure flaps L1-L4 are provided on the lower ends of the panels P1-P4 for closing the lower ends of the cartons. The size of the cartons as well as the configuration and sequence for folding the flaps can of course be different from that shown.

The packaging apparatus in general includes laterally spaced carton guides 21 and 22 for guiding cartons for movement along a linear path; a conveyor mechanism 23 for advancing cartons in step fashion along the path between the guide rails 21 and 22; a carton magazine 24 at one end of the path for storing a quantity of carton blanks in a flattened condition; a carton infeed mechanism 25 operable in timed relation with the conveyor 23 for feeding cartons from the magazine to a carton infeed station at one end of the path and for opening and erecting the carton; and a carton filler 26 at a filling station intermediate the ends of the path. In addition, the packaging apparatus includes a lower flap folding mechanism 27 intermediate the carton infeed station and the filler station for closing the flaps on the lower end of the carton, and an upper flap folding mechanism 28 intermediate the filler station and the end of the path closing the flaps on the upper end of the carton. Infeed carton support rails 29 are provided to underlie and support the cartons as they are advanced from the lower flap folding station to the filling station, and outfeed carton support rails 30 are provided to underlie and support the cartons as they are advanced from the filling station to delivery end of the carton guides. The conveyor mechanism 23 is intermittently operated as the cartons are filled at the filling station to advance the cartons in step fashion past the several stations.

The various mechanisms of the packaging machine are supported on a frame structure that includes a generally horizontal base 31, an upright rear frame 32 at the rear of the base, front frame sections 33 that are relatively lower than the rear frame 32 and which are interconnected to the rear frame by a generally horizontal intermediate frame 34. The lateral carton guide 21 is mounted on the forward end of housings 36 and 37 that are mounted on the rear frame 32 and extend forwardly therefrom in generally cantilever fashion. The other carton guide rail 22 is mounted on the upper end of posts 38 supported on the frong frame 33. The lateral carton guides 21 and 22 are conventiently in the form of opposed U-shaped channels that define guide rails along their lengthwise extending edges, and one of the lateral carton guides 22 is conveniently adjustably mounted for movement toward and away from the other lateral carton guide 21, to accommodate cartons of different size.

Figure 2:
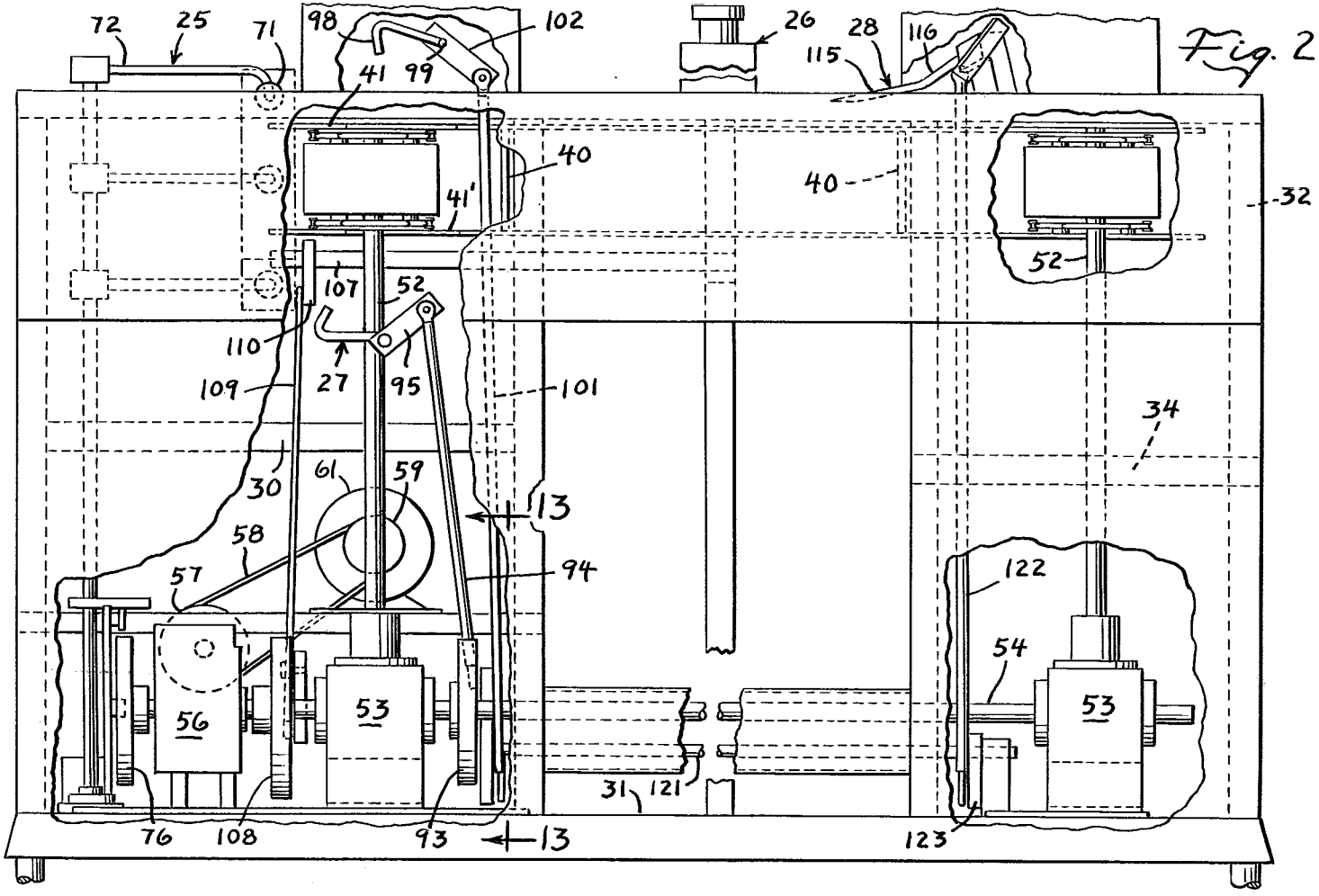
FIG. 2 is a rear elevational view of the packaging apparatus with portions of the housing broken away to illustrate details of construction.

The lateral carton guides 21 and 22 have a height less than the height of the containers and the conveyor mechanism 23 includes upper and lower elongated carrier members 41 and 41' each having a plurality of transverse pusher fingers rigid with the respective carrier member at spaced locations therealong. In the embodiment shown, the upper and lower carrier members 41 and 41' have nine carton pusher fingers designated 41*a*–41*i*. The upper and lower carrier members 41 and 41' extend parallel to the lateral carton guide 21 and the pusher fingers 41*a*–41*i* are rigid with the upper and lower carrier members and extend generally horizontaly respectively above and below the lateral carton guide 21 in a direction crosswise of the path between the lateral carton guides. The upper and lower carrier members 41 and 41' are rigidly interconnected as by tie bars 40 (FIG. 2) to move in unison.

Figure 5:
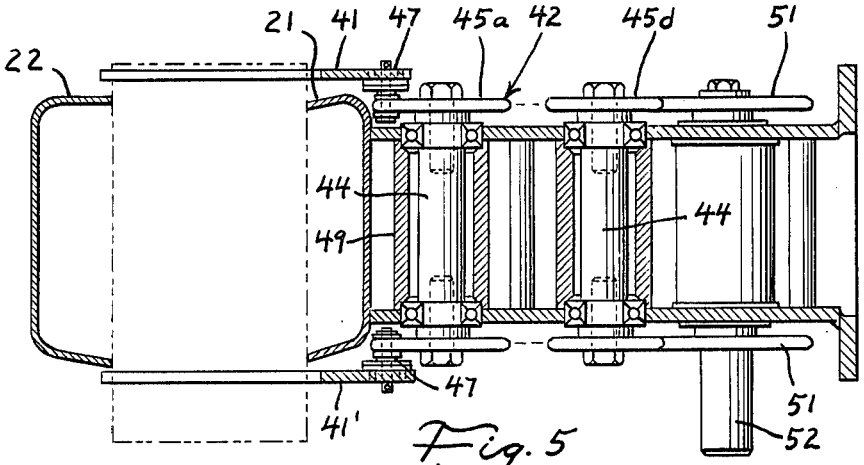
FIG. 5 is a fragmentary vertical sectional view taken on the plane 5—5 of FIG. 1, and showing parts on a larger scale.

The upper and lower carrier members are driven in a generally rectangular closed loop course by first and second carrier drives 42 and 43 respectively mounted on housings 36 and 37. The carrier drives 42 and 43 are of like construction and the same numbers are used to designate corresponding parts. As best shown in FIGS. 5 and 7–10, each carrier drive includes an upper set of four sprockets designated 45*a*–45*d* arranged in a generally rectangular pattern and a similar lower set of four sprockets also designated 45*a*–45*d* and arranged in a rectangular pattern below corresponding sprockets of the upper set, and upper and lower endless chains 46 entrained about the upper and lower sets of sprockets. As best shown in FIG. 5, corresponding ones of the upper and lower sets of sprockets 45*a*–45*d* are secured to opposite ends of shafts 44 supported for rotation by suitable bearings in sleeves 49 on the housings 36 and 37 and, preferably, one of the sprockets such as 45*d* of each set is arranged for limited adjustment relative to the other sprockets of the set to enable tightening of the chain 46. First and second upper connector means 47, 48 rotatably connect the upper carrier member 41 to the endless chains 46 on the first and second carrier drives 42 and 43 and, similarly, first and second lower connector means 47 and 48 connect the lower carrier member 41' to the lower endless chains 46 on the first and second carrier drives. Each connector means 47 and 48 is connected to a link of the respective chain and includes a bearing to rotatably connect the chain to the respective carrier member.

The upper and lower chains 46 on the first and second carrier drives are driven in one direction and at the same speed. This is advantageously achieved by upper and lower drive sprockets 51 that respectively mesh with the upper and lower chains of each carrier drive. The sprockets 51 are disposed externally of the endless chains 46 in meshing engagement thereiwth and are mounted on vertical drive shafts 52. Drive shafts 52 extend downwardly and are connected through right angle drives 53 to a drive shaft 54. Shaft 54 is connected to the output of a cycle drive mechanism such as a one revolution clutch 56, the input of which is connected through a preferably variable speed drive including pulley 57, belt 58 and pulley 59, to a drive motor 61.

As previously described, the sprockets 45*a*–45*d* of each set are arranged in a generally rectangular pattern in a horizontal plane and are offset to one side of the lateral carton guide 21. When the chains 46 are driven in one direction, they move the upper and lower carrier members in a closed loop course of generally rectangular configuration with rounded corners corresponding to the path of connectors 47 and 48 as they move with chains around the sprockets 45*a*–45*d*. The closed loop course of each carrier member has an inward run as the connectors 47 and 48 move from the sprocket 45*d* to the sprocket 45*a*; a forward run as the connector members move from the sprocket 45*a* to the sprocket 45*b*; an outward run as the connector members move from the sprocket 45*b* to the sprocket 45*c* and a return run as the connector members move from sprocket 45*c* to sprocket 45*d*. The pusher fingers 41*a*–41*i* have a length sufficient to span the space between the lateral carton guides 21 and 22 during the forward run of the carrier members and the return and inward runs are made sufficiently long to retract the fingers out of the path during the return run of the carrier members. As will be seen, the connectors 47 and 48 and hence the carrier members move at a generally constant velocity in one direction as they traverse the straight portion of the run between adjacent sprockets and there is a deceleration of the carrier members in one direction and an acceleration of the carrier members in a direction transverse to the previous direction as the connectors move around the sprockets. Thus, the carrier members are not subjected to abrupt changes in velocity during changes in their direction of movement.

Figure 1:
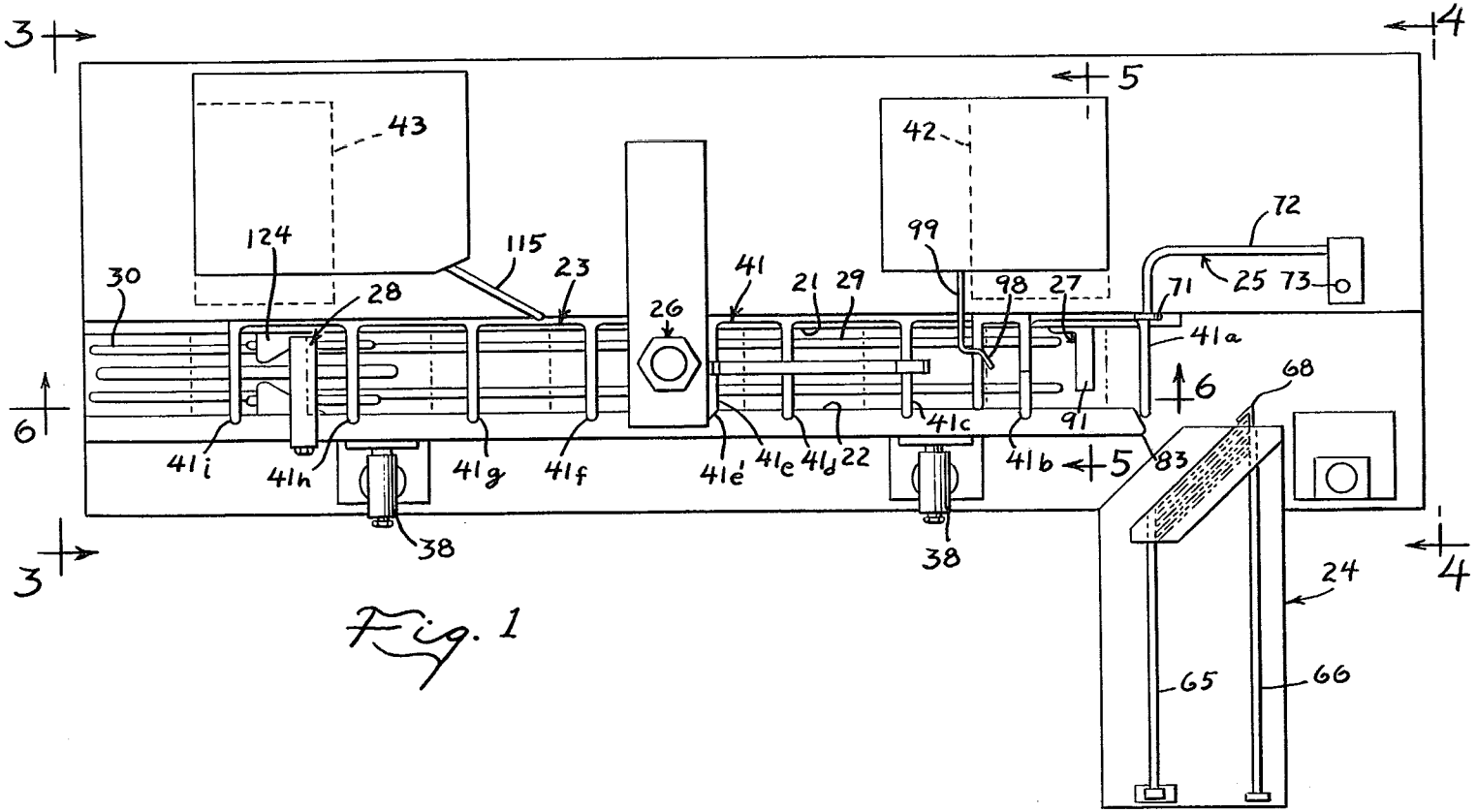
FIG. 1 is a top plan view of the packaging apparatus.
Figures 6, 7:
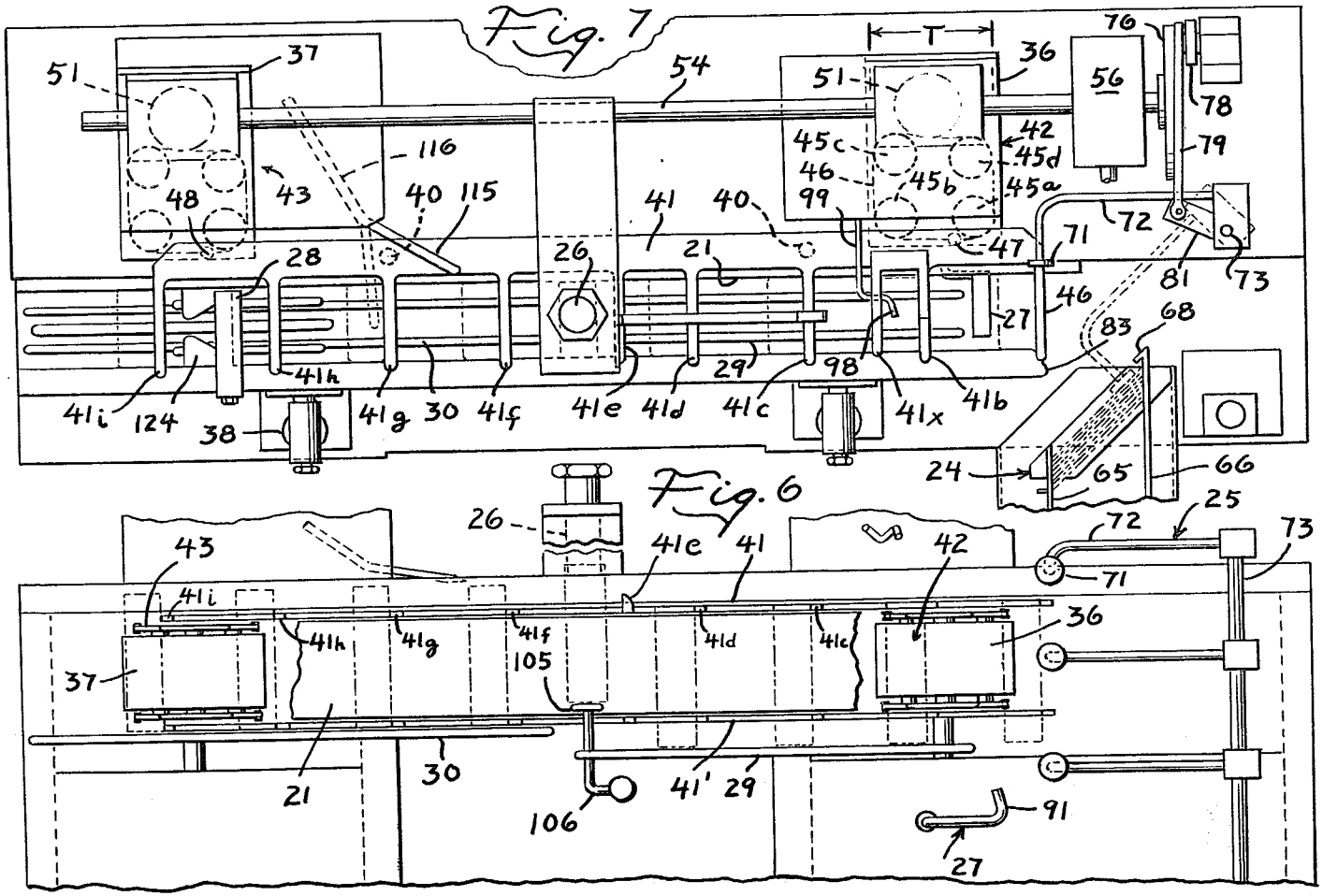
FIG. 6 is a fragmentary vertical sectional view taken on the plane 6—6 of FIG. 1.
FIGS. 7, 8, 9 and 10 are diagrammatic views illustrating the carton conveyor mechanism in different moved positions.

The cycle drive mechanism 56 is of the type which is operative, when actuated, to drive the upper and lower carrier members through one complete closed loop course and then stop the upper and lower carrier members. For example, the cycle drive mechanism 56 can be a one revolution clutch which is operative, when actuated, to drive the shaft 54 through one revolution, and the right angle drives 53 and sprockets 51 selected so as to drive the chains 46 through one complete closed loop course when the shaft 54 is driven through one revolution. For reasons pointed out hereinafter, the cycle drive mechanism is advantageously arranged to stop the carrier members 41 at a preselected location along their forward run as shown in FIGS. 1 and 7, after the connector members have passed around the sprocket 45*a* and started along the straight portion of the forward run. With this arrangement, the carrier members are stopped in a position in which the fingers 41*a*–41extend across the space between the lateral carton guides 21 and 22.

Figure 4:
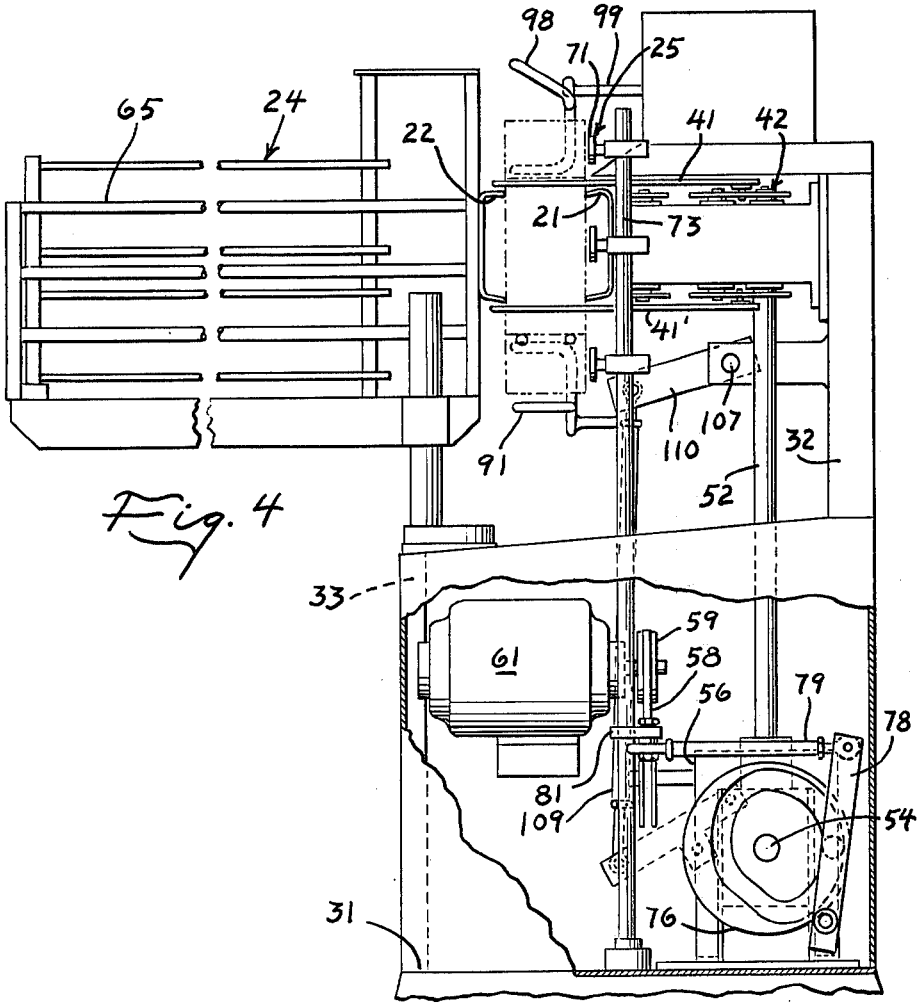
FIG. 4 is an end elevational view taken on the plane 4—4 of FIG. 1 with parts of the housing broken away.
Figures 8, 9, 10:
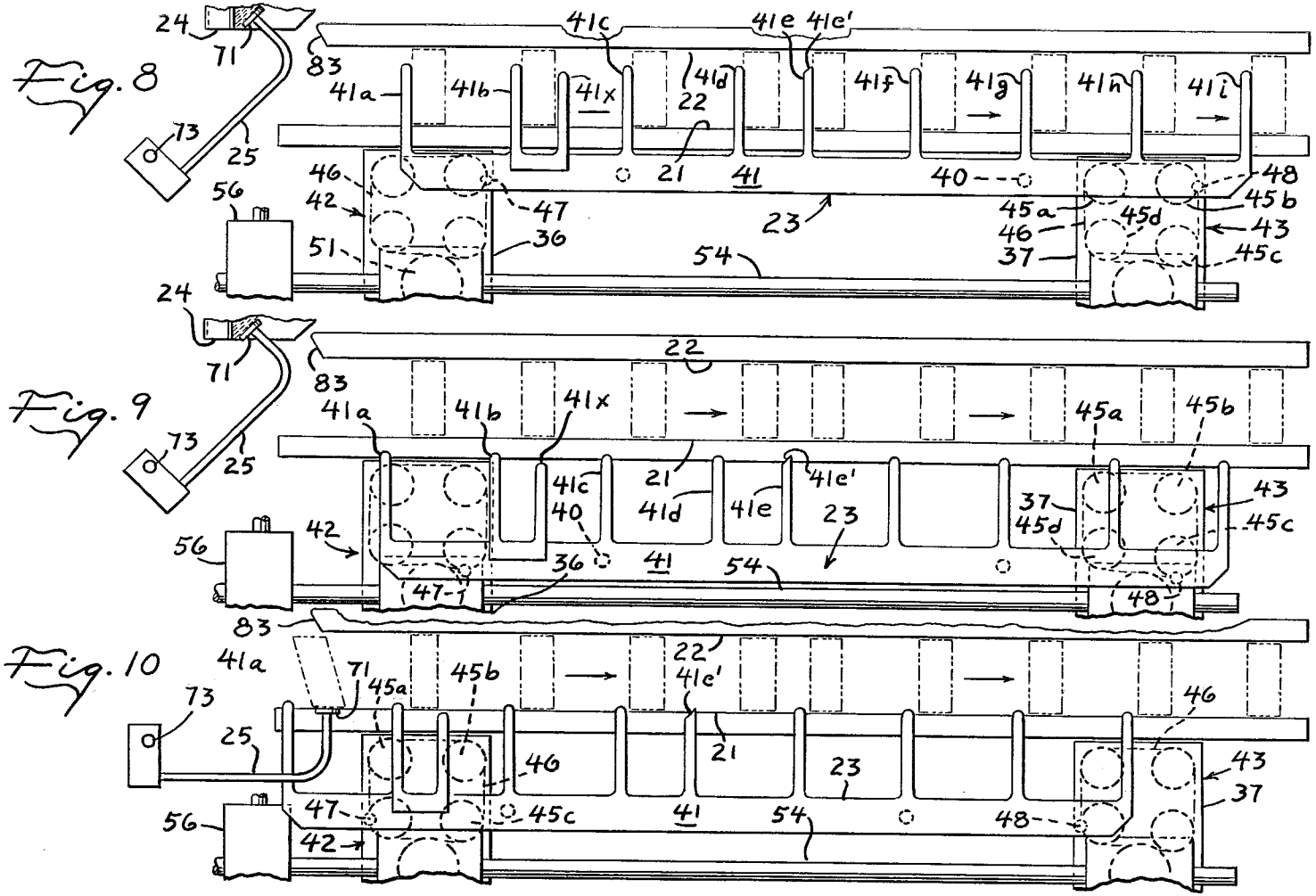
Figure 11:
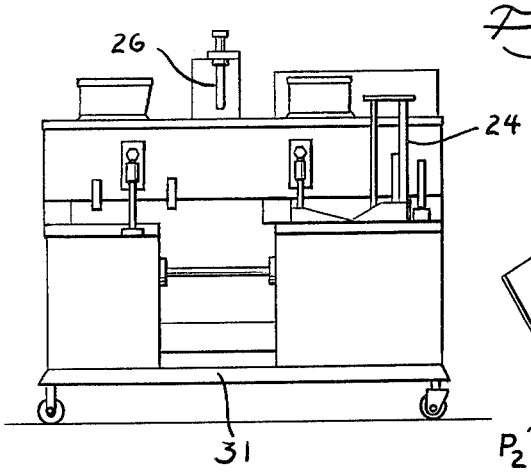
FIG. 11 is a front view of the packaging machine.
Figure 13:
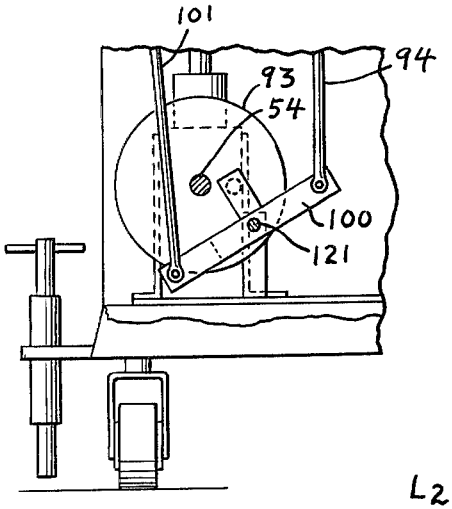
FIG. 13 is a fragmentary vertical sectional view taken on the plane 13—13 of FIG. 2.

The carton magazine 24 supports a stack of cartons in a flattened condition with the flattened carton at one end of the stack spaced from the lateral carton guide 21. The carton magazine 24 and carton feed mechanism 25 may, for example, be of the type disclosed in U.S. Pat. No. 3,418,893 to which reference is made for a more complete description of its construction and operation. In general, the carton magazine has magazine carton guides 65 and 66 extending generally perpendicular to the lateral carton guides 21 and 22 and spaced apart a distance less than the width of the flattened cartons so that the cartons extend obliquely between the guides 65 and 66 as shown in FIG. 1. The flattened cartons are yieldably urged forwardly in the magazine and a carton stop 68 is provided on the end of the magazine guides 66 to stop the cartons. The carton feed mechanism 25 includes a plurality of vacuum operated grippers 71 mounted on arms 72 that are pivoted in an upright axis 73 for movement between a position in which the vacuum grippers are adjacent the end of the lateral carton guide 21, to a position in which the vacuum operated grippers engage an end panel on the end carton of the stack, and then back to its initial position. The vacuum operated grippers are operated in timed relation with the conveyor mechanism as by a cam 76 (FIGS. 2 and 4) on the main drive shaft 54, which cam operates a cam follower on a pivoted lever 78 that is connected through a link 79 to an arm 81 on the shaft 73. The feed mechanism is normally in its retracted position shown in FIG. 7 with the vacuum operated cup 71 positioned adjacent the lateral carton guide 21 and the operation of the carton feed mechanism is timed so that the arms swing forwardly to move the grippers 71 into engagement with the end panel on a carton in the stack as shown in FIG. 8 after the carrier members have been advanced a distance at least sufficient to move the preceding carton away from the carton infeed station. The grippers 71 engage the end panel on the end carton in the stack and when the arms are returned to their normal position as shown in FIG. 10, the grippers 71 pull the end panel of the end carton off the stack and move it into engagement with the lateral carton guide 21 at the carton infeed station. As the end panel on the end carton is moved to the carton infeed station, a side panel engages a carton cam member 83 on the end of the guide rail 22 to open the carton. The pusher finger 41*a* is positioned on the carrier members at a location to engage the trailing side panel of the carton at the carton infeed station, while the carton is held by the vacuum operated grippers 71, when the carrier members 41 move inwardly along their inward run as shown in FIG. 10, to thereby aid in squaring the carton and to thereafter advance the carton therewith forwardly along the forward run of the carrier members. Lower flap folding mechanism is provided for folding the flaps on the lower end of the carton to close the same as the carton is advanced along the path away from the carton infeed station. The lower flap folding mechanism will vary with the flap configuration of the lower end of the carton and the flap folding sequence utilized for closing the lower flaps. In the embodiment shown, the lower flap folding mechanism 27 includes a member 91 mounted for swinging movement about a horizontal axis at a location to engage the lower trailing flap of a carton at a flap folding station, and suitable plows (not shown) for infolding the lower lead flap and the side flaps on the lower end of the carton as it is advanced along the path. It is also desirable to open and depress the lead flap at the upper end of the carton forwardly prior to filling, and an upper flap engaging member 98 is swingably mounted on a shaft 99 at a location to engage the lead flap on the upper end of the carton to deflect the lead flap forwardly when the carton is at the aforementioned flap folding station. The lower flap folder 91 and the upper flap depressor 98 are operated in timed relation with the conveyor and are conveniently operated from cam 93 (FIGS. 2 and 13) that oscillates a lever 100 secured to a shaft 121. One end of the lever 100 is connected through a link 94 to an arm 95 on the shaft of the lower flap folder. The other end of the lever 100 is connected through a link 101 connected to an arm 102 on the shaft 99 for the upper flap depressor 98. Thus, cam 93 operates to cause lower flap folding member 91 to swing upwardly while simultaneously causing upper flap depressor 98 to swing downwardly.

The fingers 41*a* on the carrier members operate to advance a carton from the carton infeed station to the flap folding station and fingers 41*b* are spaced from the fingers 41*a* a distance slightly less than the maximum travel T (FIG. 7) of the carrier members in a direction parallel to the carrier path and are arranged to engage the trail side of the carton at the flap folding station. In order to stablize the container at the flap folding station during folding of the lower trail flap and depressing of the upper lead flap, an auxiliary finger 41*x* is conveniently mounted on the carrier members and spaced forwardly from the pusher fingers 41*b* a distance only slightly greater than the width of the cartons measured in the direction lengthwise of the path, to extend closely adjacent the lead side of the carton engaged by the pusher fingers 41*b*. Finger 41*c* is spaced forwardly from the finger 41*b* a distance slightly less than the maximum forward travel T of the carrier members and the finger 41*d* is similarly spaced from the finger 41*c* and is located in relation to the nozzle 26 to advance a carton to a filling station below the nozzle, when the carrier members reach the end of the their forward travel.

Figure 3:
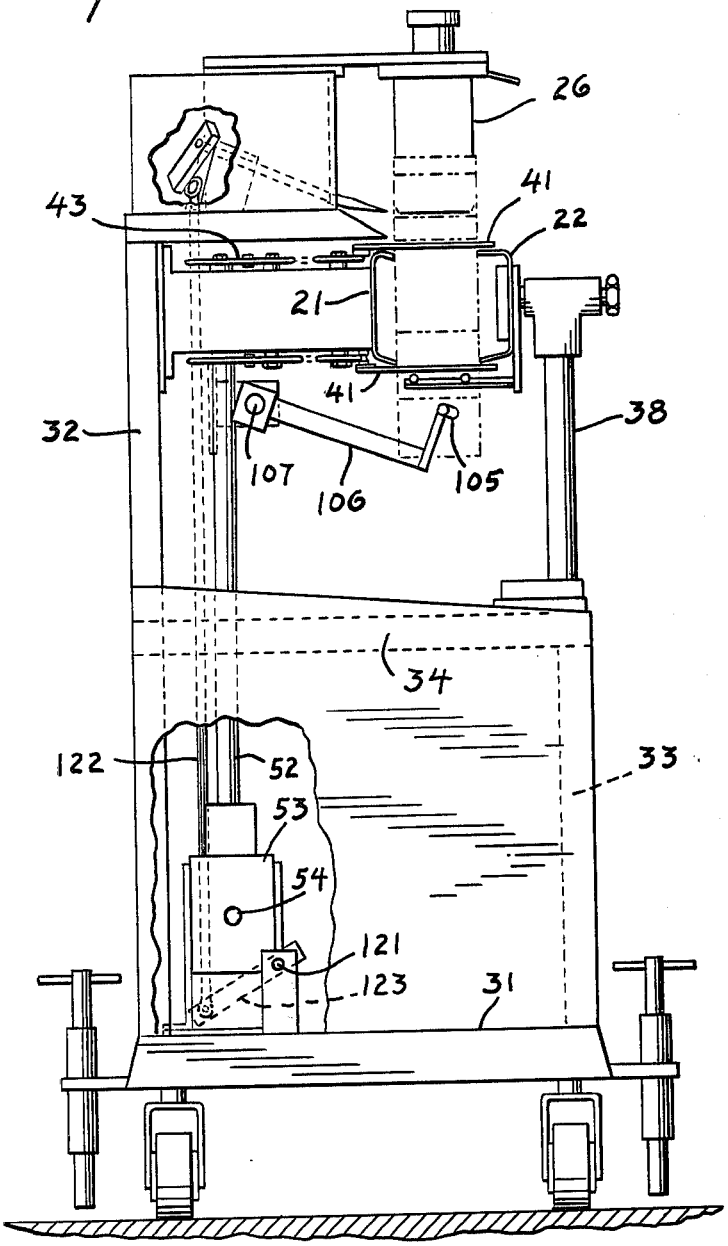
FIG. 3 is an end elevational view taken on the plane 3—3 of FIG. 1 with parts of the housing broken away.

The fill nozzle 26 is connected to a source of product supply. In the preferred embodiment illustrated, the filler nozzle is of a type which is operative to continuously dispense a stream of semi-fluid or plastic material such as ice cream. As best shown in FIG. 6, the infeed carton support rails 29 are disposed at a level to support the cartons with their upper ends spaced substantially below the nozzle 26 as the cartons are advanced to the filling station, to avoid interference with the continuously emerging stream of material from the nozzle. A carton elevator mechanism 105 (FIG. 3) is provided for elevating the carton at the fill station into a position in which at least the upper portion of the carton extends around the nozzle. The carbon elevator mechanism 105 is mounted on an arm 106 for swinging movement about the axis of the shaft 107 and the elevator mechanism is operated in timed relation with the conveyor mechanism as by a cam 108 having a cam follower connected through a linkage 109 to an arm 110 on the shaft 107 (see FIG. 2). Operation of the carton elevator mechanism is timed so that the carton is elevated into a position around the nozzle as soon as the carrier members reach the forward end of the their travel in which the finger 41*d* advances a carton into position at the filling station, and the carrier members then continue their closed loop course and return to their starting position shown in FIG. 7. As the carton at the filling station is filled, it moves downwardly and depresses the elevator. When the elevator reaches a predetermined position in which the upper end of the carton is adjacent the lower end of the nozzle, it actuates a switch, such as an electric or pneumatic switch. Which controls actuation of the cycle drive mechanism 56, to drive the carrier members through a succeeding closed loop course. The cam 108 is operative when the cycle drive mechanism drives shaft 54, to first rapidly lower the carton elevator so that a succeeding carton can be advanced to the filling station and thereafter elevate the carton at the filling station, as previously described. The outfeed carton support rails 30 are disposed at a level above the infeed carton support rails and such as to support the carton as it is moved across the nozzle.

Since material is being continuously dispensed from the nozzle 26, it is desirable to move the carton at the filling station crosswise of the filling nozzle and away from the filling station as soon as it is filled. The fingers 41*e* on the carrier member are spaced from the preceding fingers 41*d* a distance less than the travel T of the carrier members and are located so as to extend closely adjacent the trail side of the carton at the filling station, when the carrier members are in their stop position shown in FIG. 7. Thus, fingers 41*e* operate to advance the filled container away from the filling station while the fingers 41*d* operate to advance a succeeding container into position at the filling station below the nozzle. The end portion of the pusher finger 41*e* is beveled and inclined as shown at 41*e'* in FIGS. 1 and 6 to depress the lead flap on the upper end of the carton engaged by pusher 41*d*, as the carrier members move inwardly from the position shown in FIG. 10 to the position shown in FIG. 7. This assures that the lead flap on the next carton to be advanced to the filling station will not engage material emerging from the nozzle.

Finger 41*f* is spaced from the finger 41*e* a distance slightly less than the travel T of the carrier members and similarly fingers 41*g*, 41*h* and 41*i* are spaced from the preceding container a corresponding distance.

An upper flap folding mechanism is provided for closing the flaps on the upper end of the carton. This upper flap folding mechanism will vary dependent upon the type of flaps and the flap folding sequence utilized. In the embodiment illustrated, it is conveniently of the type disclosed in U.S. Pat. No. 3,364,651 and which includes an elongated arm 115 (FIG. 1) having a shaft 116 mounted for turning movement about an axis oblique to the path of travel of the carton, and the arm is swingable from a position as shown in solid lines in FIG. 1 extending generally lengthwise of the path, to a position as shown in phantom in FIG. 7 extending crosswise of the path. The arm 115 is operated in timed relation with a conveyor mechanism from the shaft 121 through an arm 123, a link 122 to arm attached to the shaft 116. As more fully described in the aforementioned U.S. Pat. No. 3,364,651, the arm 115 is operative when moved to the position shown in FIG. 1 to depress an upper flap on the carton laterally outwardly of the carton to facilitate infolding of the lead and trail flaps, and is operative when moved to a position crosswise of the carton to fold the trail flap on the carton forwardly. Plows 124 are provided for folding the lead and end flaps on the upper end of the carton to close the same as it is advanced toward the outlet end of the carton guides.

From the foregoing it is thought the construction and operation of the packaging apparatus will be readily understood. The packaging apparatus is intermittently operated to cycle the machine each time a carton is filled at the filling station. The carrier members are normally stopped in a position shown in FIG. 1 in which the fingers 41*a*–41*i* extend crosswise between the lateral carton guides with fingers 41*a*–41*c* and 41*f*–41*i* in engagement with the trail side of the cartons. When a carton at the filling station is filled, it actuates a switch that operates the cycle control 56 to move the carrier members from their normal position shown in FIG. 7, through a closed loop course sequentially forwardly as shown in FIG. 8, then outwardly as shown in FIG. 9, then rearwardly as shown in FIG. 10, and then back to the normal or stop position shown in FIG. 7. As the carrier members 41 move forwardly, finger 41*a* advances a carton away from the carton infeed station and finger 41*b* advances a carton past the lower flap folding mechanism and the upper flap depressing mechanism. The auxiliary finger 41*x* extends alongside the lead side of the carton engaged by the fingers 41*b* to stabilize and support the carton during flap folding. Finger 41*e* moves a filled container away from a position below the nozzle as the carrier members are moved forwardly and finger 41*d* moves the next succeeding container into position below the nozzle. Fingers 41*g*, 41*h* and 41*i* advance the cartons in step fashion past the upper flap folding mechanism.

The carton infeed mechanism 25 is operated after the finger 41*a* has advanced a carton away from the carton infeed station, and the gripper members are moved into engagement with an end panel on the face of the carton at the end of the stack as shown in FIG. 8 and then back to move the end panel on that carton into engagement with the guide rail 21 at the infeed station as shown in FIG. 10. A cam member 83 engages the side panel of the carton as it is moved off the stack to the infeed station and deflects the carton past its square position as shown in FIG. 10. As the carrier members move along their inward run, fingers 41*a* engage the trail side of the carton at the infeed station to initially square the carton, and to thereafter advance the carton along the path until the carrier members stop in the position shown in FIG. 7. The fingers on the carrier members extend fully across the space between the lateral guides 21 and 22 to fully support the trail side of the cartons during advancement and while the carrier members are in their stop position shown in FIG. 7. The sprockets 45*a*–45*d* and chains 46 drive the carrier members at a substantially constant velocity along the straight portions of the generally rectangular course, and gradually decelerate motion of the carrier members in one direction while accelerating motion of the carrier members in a relatively transverse direction, at the rounded corners of the course. Further, the disclosed carrier and carrier drive enable use of auxiliary fingers such as 41*x* which are spaced from a preceding pusher finger a distance only slightly greater than the depth of the carton measured along the path, to stabilize the cartons at one or more stations, as desired. In addition it will be seen that the generally straight inward motion imparted to the carrier members by the disclosed sprocket and chain carrier drive, can be advantageously utilized to aid in squaring the carton at the carton infeed station, and to deflect or manipulate end flaps on the cartons at the other stations.

The embodiments of the invention in which an exclusive property or privilege is claimed are defined as follows:

1. In a packaging apparatus having a filling station and material dispensing means at the filling station, first and second lateral carton guides for guiding cartons for movement along a linear path past said filling station, conveyor means for advancing cartons in step fashion along said path, the improvement wherein the conveyor means includes at least one elongated carrier member paralleling said path having a plurality of transverse pusher fingers rigid with the carrier member at spaced locations therealong and extending in a direction crosswise of said path, first and second carrier drives spaced apart in a direction lengthwise of said carrier member and offset from one side of said path, each carrier drive including a set of four sprockets arranged in a generally rectangular pattern in a sprocket plane paralleling said path and an endless chain entrained around the sprockets of each set, first and second connector means rotatably connecting the carrier member respectively to the endless chains of the first and second carrier drives, means for driving the chains of the first and second carrier drives in one direction and at the same speed, the sprockets of each set being arranged in said sprocket plane and in relation to said path such that the chains of the first and second carrier drives, when driven in said one direction, move said carrier member in a horizontal closed loop course of generally rectangular configuration with rounded corners, the course having inward and outward runs extending respectively toward and away from said path and forward and return runs extending generally lengthwise of said path, the fingers on the carrier member having a length sufficient to span the space between the first and second lateral carton guides on the forward run and being retracted out of said path on the return run.

2. A packaging machine according to claim 1 wherein said means for driving the chains of the first and second carrier drives includes a selectively operated cycle drive mechanism operative when actuated to drive the first and second carrier drives and move the carrier member through one complete closed loop course and then stop the carrier member.

3. A packaging apparatus according to claim 2 wherein said material dispensing means includes a downwardly opening dispensing nozzle above said path at said filling station for continuously dispensing a stream of semi-fluid material, said carrier member having a fill station pusher finger at a location therealong to advance a carton to said filling station below the nozzle when the carrier member is moved to the forward end of its forward run, carton elevator means at the filling station operated in timed relation with said carrier member for elevating a carton into position around the nozzle, and means operative when the carton at the filling station is filled for actuating said cycle drive mechanism.

4. A packaging apparatus according to claim 3 wherein said cycle drive mechanism is arranged to stop the carrier member at a preselected location along its forward run in which the fill station pusher finger is spaced from the forward end of the forward run a distance substantially greater than the depth of a carton measured along said path, said carrier member having a second fill station pusher finger at a location therealong to extend adjacent the trail side of a carton at the filling station when the carrier member is stopped at said preselected location for moving the filled carton away from the filling station.

5. A packaging apparatus according to claim 1 wherein each carrier drive includes a drive sprocket located externally of its endless chain and in meshing engagement therewith.

6. A packaging apparatus according to claim 1 wherein said carrier member has an auxiliary finger spaced in the direction of movement of the cartons along the path from one of the pusher fingers a distance only slightly greater than the depth of a carton measured along the path to support the lead side of a carton while said one of the pusher fingers is in engagement with the trail side of the carton.

7. In a packaging apparatus for filling and closing generally rectangular cartons of the type having first and second end panels interconnected by first and second side panels and closure flaps on at least one end of some of the panels, the packaging apparatus having a filling station and material dispensing means at the filling station, first and second lateral carton guides spaced apart a distance corresponding to the spacing of the carton end panels to receive the rectangular cartons therebetween and guide the cartons for movement along a linear path past the filling station with the side panels of the carton disposed crosswise of said path, conveyor means for advancing the cartons in step fashion along said path between the lateral carton guides, the improvement wherein the conveyor means includes upper and lower elongated carrier members each having a plurality of transverse pusher fingers rigid with the carrier member at spaced locations therealong, the upper and lower carrier members extending parallel to the first lateral carton guide and the pusher fingers on the upper and lower carrier members extending generally horizontally respectively above and below the first lateral carton guide in a direction crosswise of said path, first and second carrier drives spaced apart in a direction lengthwise of said carrier member, the first and second carrier drives each including an upper set of four sprockets arranged in a rectangular pattern and a lower set of four sprockets arranged in a rectangular pattern and upper and lower endless chains respectively entrained about the upper and lower sets of sprockets, first and second upper connector means rotatably connecting the upper carrier member to the upper endless chains on the first and second carrier drives and first and second lower connector means rotatably connecting the lower carrier member to the lower endless chains on the first and second carrier drives, means for driving the chains on the first and second carrier drives in one direction and at the same speed, the sprockets of each set being arranged in a generally horizontal plane and in relation to said first lateral carton guide such that the chains, when driven in said one direction, move each of the upper and lower carrier members in a closed loop course of generally rectangular configuration with rounded corners, each closed loop course having inward and outward runs extending respectively toward and away from said path and forward and return runs extending generally lengthwise of said path, the pusher fingers on the upper and lower carrier members having a length sufficient to span the space between the first and second lateral carton guides on the forward run and being retracted out of said path on the return run.

8. A packaging machine according to claim 7 wherein said means for driving the chains of said first and second carrier drives includes a selectively operated cycle drive mechanism operative when actuated to drive the first and second carrier drives and move the upper and lower carrier members through one complete closed loop course and then stop the upper and lower carrier members.

9. A packaging apparatus according to claim 8 wherein said material dispensing means includes a downwardly opening dispensing nozzle above said path at the filling station for continuously dispensing a stream of semi-fluid material, said upper and lower carrier members each having a fill station pusher finger at a location thereon to advance a carton to the filling station below the nozzle when the upper and lower carrier members are moved to the forward end of their forward run, carton elevator means at the filling station operated in timed relation with said carrier members for elevating a carton into position around the nozzle, and means operative when a carton at the filling station is filled for actuating said cycle drive mechanism.

10. A packaging apparatus according to claim 9 wherein said cycle drive mechanism is arranged to stop the upper and lower carrier members at a preselected location along their forward run in which the fill station pusher finger is spaced from the forward end of its forward run a distance substantially greater than the width of a carton measured along said path, said upper and lower carrier members each having a second fill station pusher member at a location therealong to extend adjacent the trail side of a carton at the filling station when the upper and lower carrier members are stopped at said preselected location for moving the filled carton away from the filling station.

11. A packaging apparatus according to claim 7 wherein each carrier drive includes upper and lower drive sprockets located externally of the respective upper and lower chains and in meshing engagement therewith.

12. A packaging apparatus according to claim 7 including means extending between the upper and lower carrier members and rigidly interconnecting them for movement in unison.

13. A packaging apparatus according to claim 7 wherein at least one of said carrier members has means on at least one finger engageable with one of the flaps on the carton as said one of said carrier members is moved along its inward run for moving a flap on that carton relative to the panels of the carton.

14. A packaging apparatus according to claim 7 wherein at least one of said carrier members has an auxiliary finger spaced in the direction of movement of the cartons along the path from one of the pusher fingers a distance only slightly greater than the depth of the cartons measured along said path to support the lead side of a carton while said one of the pusher fingers is in engagement with the trail side of that carton.

15. A packaging apparatus according to claim 14 wherein at least one of the side panels on each carton has one of said end closure flaps on one end thereof, and flap engaging means engageable with said one end closure flap on said one of said side panels of the carton while the auxiliary finger is in engagement with the lead side of the carton for deflecting said one end closure flap relative to said one side panel.

16. A packaging apparatus according to claim 7 including a magazine for supporting a stack of cartons in a flattened condition with the flattened carton at one end of the stack having one side spaced from said first lateral carton guide, the flattened carton having said first end panel and said first side panel at said one side of the flattened cartons and said second side panel and said second end panel at the other side of the flattened cartons, vacuum operated gripper means operated in timed relation with the conveyor means for gripping the first end panel on the end carton in the stack and for moving the first end panel away from the stack and into engagement with the first lateral carton guide at a carton infeed station, means for opening the flattened carton as the first end panel is moved off the stack and into engagement with the first lateral carton guide, the upper and carrier members each having a finger at a location therealong operative during the inward run of its generally rectangular course to move into a position alongside the carton at the carton infeed station.

* * * * *